US009623461B2

(12) United States Patent
Nespoli et al.

(10) Patent No.: US 9,623,461 B2
(45) Date of Patent: Apr. 18, 2017

(54) STRAIGHTENING MACHINE

(71) Applicant: PRIMETALS TECHNOLOGIES ITALY S.R.L., Marnate (VA) (IT)

(72) Inventors: Danilo Nespoli, Vanzaghello Mi (IT); Emanuele Pace, Legnano-Mi (IT)

(73) Assignee: Primetals Technologies Italy S.R.L., Marnate (VA) (IT)

( * ) Notice: Subject to any disclaimer, the term of this patent is extended or adjusted under 35 U.S.C. 154(b) by 112 days.

(21) Appl. No.: 14/654,281

(22) PCT Filed: Dec. 5, 2013

(86) PCT No.: PCT/EP2013/075670

§ 371 (c)(1),
(2) Date: Jun. 19, 2015

(87) PCT Pub. No.: WO2014/095393

PCT Pub. Date: Jun. 26, 2014

(65) Prior Publication Data

US 2015/0360270 A1 Dec. 17, 2015

(30) Foreign Application Priority Data

Dec. 19, 2012 (EP) ..... 12425201

(51) Int. Cl.

| | |
|---|---|
| ***B21D 1/05*** | (2006.01) |
| ***B21D 3/05*** | (2006.01) |
| ***B22D 11/12*** | (2006.01) |

(52) U.S. Cl.
CPC ..... *B21D 1/05* (2013.01); *B21D 3/05* (2013.01); *B22D 11/1226* (2013.01)

(58) Field of Classification Search
CPC ..... B21D 1/05; B21D 3/05; B22D 11/1226
See application file for complete search history.

(56) References Cited

U.S. PATENT DOCUMENTS 5,327,760 A 7/1994 Böhmer et al.

FOREIGN PATENT DOCUMENTS

| | | |
|---|---|---|
| EP | 0689884 A1 | 1/1996 |
| WO | 2008025814 A1 | 3/2008 |

*Primary Examiner* — Teresa M Ekiert
(74) *Attorney, Agent, or Firm* — Laurence A. Greenberg; Werner H. Stemer; Ralph E. Locher

(57) ABSTRACT

A straightening machine includes a frame supporting housings in which each housing receives a roll shaft rotatable about its axis. At least one first assembly includes a first guide defining a first convex surface and a first corresponding guided element defining a first concave surface. The first surfaces contact each other at a first contact surface. At least one second assembly includes a second guide defining a second convex surface and a second corresponding guided element defining a second concave surface. The second surfaces contact each other at a second contact surface. A device for rotating at least one roll shaft housing carries out a rotation being guided by the assemblies about a virtual axis transverse to a roll shaft axis, to compensate bending due to straightening of a product.

15 Claims, 7 Drawing Sheets

STRAIGHTENING MACHINE

BACKGROUND OF THE INVENTION

Field of the Invention

The invention relates to a machine for straightening long metal products such as beams or rails.

Leveling devices, known as levelers or strengthening machines, are used to remove flatness defects in long products following hot or cold rolling. After hot rolling, cooling and conditioning phases, the rolled products may have straightness, bending of web or out of square defects. These geometric defects visibly affect rolled products.

Levelers with multiple rollers arranged such that they overlap, establishing an undulating route for the long product, which is then subjected to bending effects in alternating directions, are used to level such rolled long metal products.

A motorized drive system makes it possible to actuate the rollers in rotation and, by friction, to move the long product forward at a given speed.

In order to offset the bending of the shafts where the rolls are mounted caused by the separation stress attributable to the passage of the strip, several systems have been invented.

For example, document U.S. Pat. No. 5,327,760 discloses in one embodiment a straightening machine wherein the compensating rotation of the rolls shaft is realized by use of contact between flat and convex surfaces 20 and 21. The intersection between these two surfaces is a line, and the entire load of the anti bending rotation is distributed on this contact line. Of course this induces an increased wearing of the mechanical parts and implies frequent changes of these worn parts, which leads to productivity diminution as the straightening machine can not be used during this repairing time.

Further, to allow the rotation, according to this document, an important clearance is needed between the two contact surfaces. As a consequence, there is an uncertainty on the exact location of the rotating point and the control of this rotation is difficult because for one command of the cylinder driving the rotation, location of the rotation center cannot be predicted. This can give two different rotations centers for the same set point or command. So, with this solution there is a repeatability problem which leads to uncertainty, because no exact prediction of the location of the rotation center can be made and the control of the rotation actuators is therefore almost impossible.

Furthermore, in the solution disclosed in document U.S. Pat. No. 5,327,760, the rotation is realized in a portion not supported. Therefore the straightening stress into the bearings is increased because of the above mentioned clearance and because of the small contact surface.

BRIEF SUMMARY OF THE INVENTION

An objective of the present invention is to solve the above mentioned problems.

This objective is reached with a straightening machine comprising a frame supporting housings, each housing receiving a roll shafts rotatable about its axis, the straightening machine further comprising:

- at least a first assembly comprising a first guide defining a first convex surface and a first corresponding guided element defining a first concave surface, said first surfaces contacting each other at a first contact surface;
- at least a second assembly comprising a second guide defining a second convex surface and a second corresponding guided element (72) defining a second concave surface, the second surfaces contacting each other at a second contact surface (S2),
- means for rotating at least one roll shaft housing (22,26, 28,38, 90,92 98,), the rotation being guided by the assemblies about a virtual axis (P) transverse to the roll shaft axis X, to compensate bending due to straightening of a product.

According to other features taken alone or in combination:

- the straightening machine further comprises:
  - at least a third assembly comprising a third guide defining a third convex surface and a third corresponding guided element defining a third concave surface, said third surfaces contacting each other at a third contact surface,
  - at least a fourth assembly comprising a fourth guide defining a fourth convex surface and a fourth corresponding guided element defining a fourth concave surface, the fourth surfaces contacting each other at a fourth contact surface, the rotation being also guided by third and fourth assemblies about the virtual axis transverse to the roll shaft axis X, to compensate bending due to straightening of a product,

- the assemblies are designed and are located such that in a longitudinal cross section of the roll shaft, the contact line of each assembly is respectively part of a first and a second virtual circle, first and second virtual circles having different radii and having the same virtual centre, the roll shaft housing being rotatable about said centre for correction of the bending induced by the product to be straighten,
- the guides are fixedly attached to the frame of the straightening machine,
- the guided elements are fixedly attached to one of the roll housings and rotate with the roll shaft housing during anti-bending rotation,
- each guide is attached with a corresponding guided element by means of spring screws received in a recesses defined in each guide and in each guided element, the spring screw allowing rotation of the guided element relative to the guide during anti-bending rotation of the roll shaft housing,
- each recess of each guided element receiving a spring screw has a diameter greater than the diameter of the spring screw such that a clearance exists between the spring screw and the wall of the recess of the guided element, whereas the spring screw is fixedly screwed in the recess of the corresponding guide, the clearance allowing rotation of each guided element relative to the convex guide during anti-bending rotation of the roll shaft housing,
- the means for rotating the roll shaft housing define a first contact surface between a convex and a concave surface, and wherein in a longitudinal cross section of the roll shaft housing, the contact surface is a contact line part of virtual circle, the centre of this circle being also point P,
- the means for rotating the rolls shaft housing comprises a second contact surface between a convex and a concave surface,
- the means for rotating the roll shaft housing comprise:
  - a first screw piston with an extremity defining a concave surface
  - a first sliding element comprising a convex surface complementary to and cooperating with the concave surface of the first screw piston, a second screw piston with an extremity defining a concave surface, a second sliding element comprising a convex surface complementary to and cooperating the with the concave surface of the second screw piston, each screw piston being received and maintained in a passage defined in the frame of the straightening machine, the means for displacing the roll shaft housing further comprise at least two driving bolts, each driving bolt cooperating with a screw piston for translating each screw piston, and each driving bolt having an external screwed portion, the means for displacing the roll shaft housing further comprise at least two aligned driving shafts, each driving shaft engaging with the external screwed portion of a driving bolt for rotating each screw piston, each driving shaft has a geared extremity and wherein a gear coupling system is interposed between the two driving shafts, the gear coupling system being displaceable between:

a first position wherein only one driving shaft is rotated by a driving motor, this position leading to the rotation of the roll shaft housing and a second position wherein both driving shafts are rotated by the driving motor, provoking translation of the roll shat housing 12.

the means for displacing the roll shaft housing further comprise a shift fork driven by a cylinder, said shift fork displacing the gear coupling system between the first and the second position and vice-versa, the straightening machine comprises at least two arms, each arm defining a recess, each recess receiving a screw piston end and a sliding element.

BRIEF DESCRIPTION OF THE SEVERAL VIEWS OF THE DRAWING

Other advantages of the present invention will be readily understood from the following non-imitating specification and attached drawings wherein.

DISCRIPTION OF THE INVENTION

Figure 1:
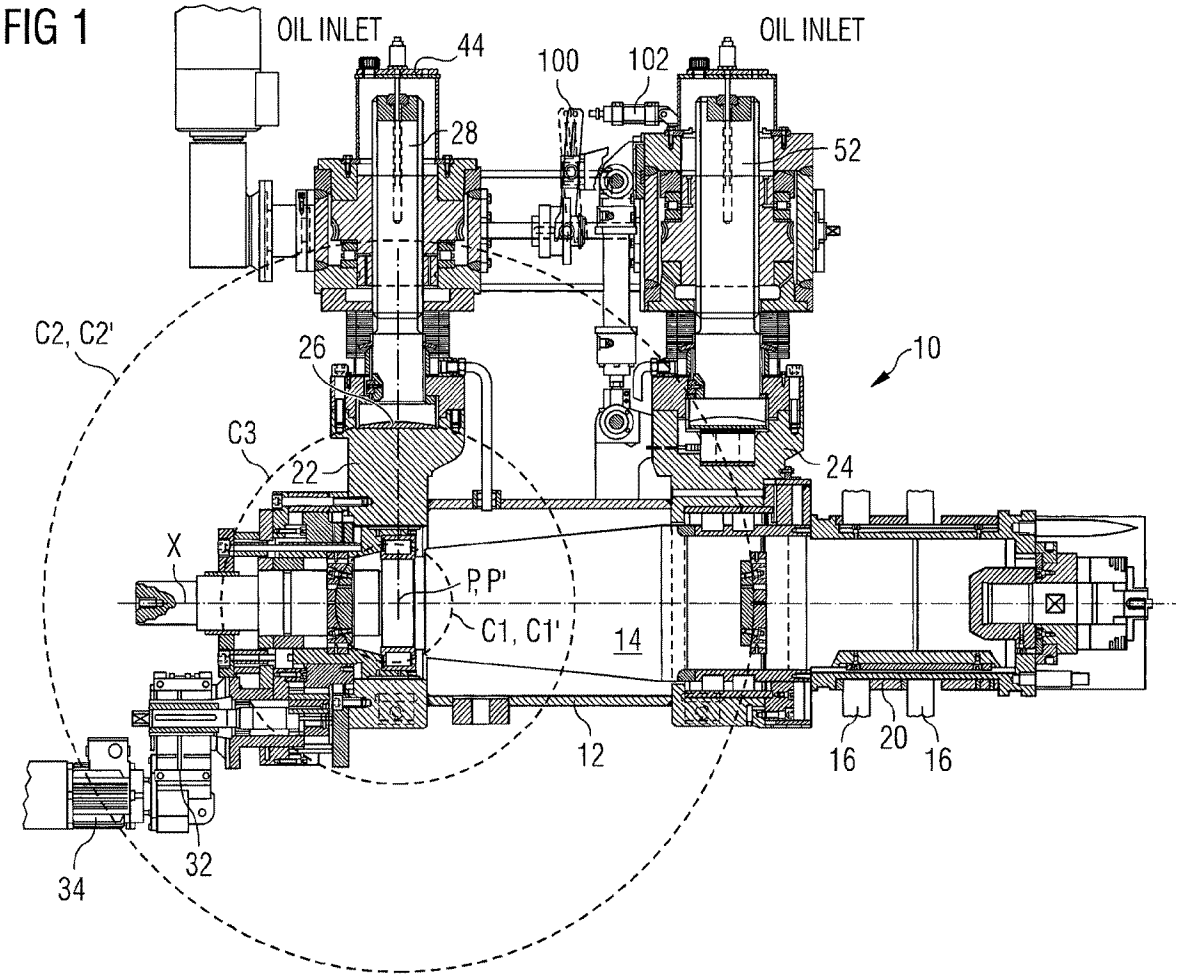
FIG. 1 is a longitudinal cross section of a roll shaft of leveling machine according to the invention.

FIG. 1 shows partially the housing 12 of straightening machine 10. A roll shaft 14 is located in the housing 10 and can rotate about its longitudinal axis X thanks to a plurality of bearings interposed between the roll shaft and the housing 12. The roll shaft receives at one of its extremity a straightening roller 20 comprising two straightening disks 16 and 18. The roll straightening rollers 20 is supported in a cantilever fashion outside the housing 14. The straightening roll 20 is designed to act on the product to be leveled. A motor 34 and a gear assembly 32 are provided for driving the rotation of the roll shaft 14.

It will be understood that if only one roll shaft 14 is shown in FIG. 1, a straightening machine according to the invention comprises a plurality of roll shafts and rollers defining a path for the product to be leveled.

Figure 2:
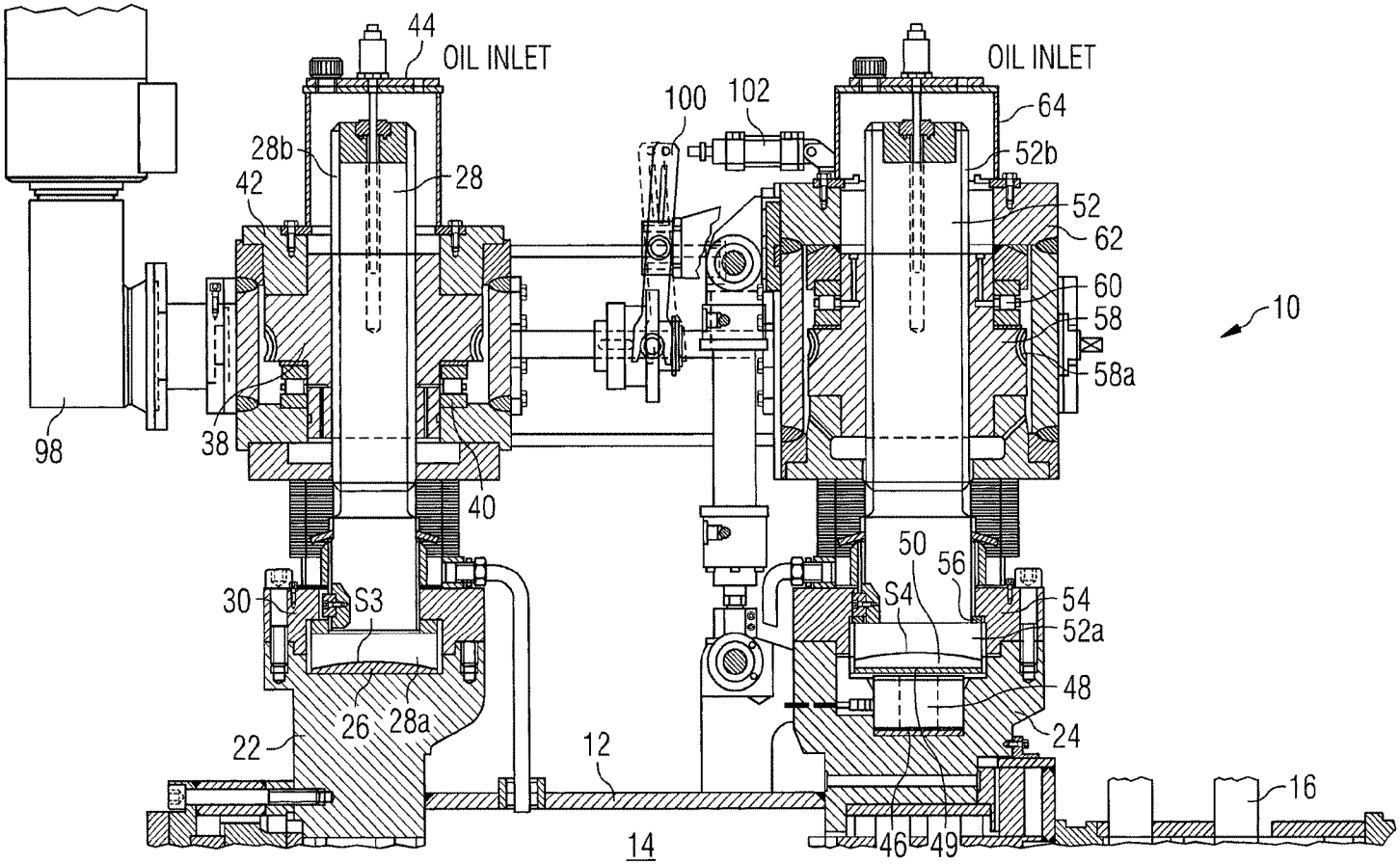
FIG. 2 is an enlargement of FIG. 1 showing the rotating driving system according to the invention.

According to the invention, and as this can be best seen on FIG. 2, the housing further comprises two supporting arms 22 and 24, left and right arm when watching FIG. 1, extending transversally to the roll shaft axis. In the embodiment of FIG. 1, the two arms 22 and 24 extend upward. The two arms 22 and 24 are horizontally spaced apart one from the other.

The left (or first) arm 22 defines a recess receiving a convex sliding element 26 and the lower end 28*e* of a screw piston 28. The sliding element 26 has a convex surface and a flat surface. The flat surface is directed toward and lies on the left arm of the straightening machine whereas the convex surface of the sliding element 26 is directed toward the screw piston end 28*e*.

The screw piston end 28*e* is linked to the left arm by mean of an annular flange 30 having a U shape. A chock ring 32 is interposed between the screw piston end 28 and the flange 30. The screw piston end 28 has a cylindrical shape defining a concave extremity which is complementary with the convex sliding element 26. This lower end 28*e* of the screw piston has a diameter higher than the diameter of the body of the screw piston 28. This creates a shoulder where the chock ring 32 is supported. It has to be noted that in the cross section shown in FIG. 2, the contact surface S3 of the convex sliding element 26 and of the concave screw piston end 28*e* is a line part of a virtual circle C3. As will be latter explained, the centre of the circle C3 is superimposed with the anti-bending center of rotation of the roll shaft. In other words, the horizontal transverse anti-bending axis passes through the center of the circle C3.

The body of the left screw piston 28 has a screwed portion 28*b* cooperating with a driving bolt 38. The rotation of the driving bolt 38 provokes the translation of the screw piston 28. The driving bolt 38 has a cross-shape section and lies on a horizontal roll bearing 40 allowing its rotation about the axis of the screw piston 28. The driving bolt 38 also comprises an external thread for its cooperation with a worm screw, as will be explained latter.

The driving bolt 38 is maintained in position by means of a second flange 42. A portion of the screw piston extends upwardly beyond the second flange 42 and is covered by a cap 44. The cap defines an oil inlet for lubrication of the assembly.

The left screw piston 28 is designed to push on the sliding element 32 which in turn pushes on the housing 12 of the roll shaft 14 of the straightening machine 10 provoking the corrective bending of the roll shaft.

The right (or second) supporting arm 24 also defines a recess receiving a spacer 46 on which lies a load sensors 48. The spacer is used to correct the flatness default of the downward surface of the recess which could influence the load measurement.

The recess also receives another spacer 49 which in turn supports a second convex sliding element 50 and the lower end 52*a* of a right (or second) convex screw piston 52. The sliding element 50 and the lower end (or extremity) 52*a* define a contact surface S4. The right screw piston end 52 is fixedly secured to the right arm by mean of screwed ring flange 54. A chock ring 56 is interposed between the end (or lower extremity) of the right screw piston 24 and the flange 54. The lower end 52*a* of the right screw piston 52 has a cylindrical shape with a concave extremity which is complementary with the right convex sliding element 50. This lower end 52*a* of the right screw piston 52 has a diameter higher than the diameter of the body of the screw piston. This creates a shoulder where the chock ring 56 is located.

The body of the right screw piston 52 has an external screwed portion 52*b* cooperating with a right driving bolt 58. The rotation of the right driving bolt 58 provokes the translation of the screw piston 52. The driving bolt has a cross-shape and cooperates with an upward horizontal roll bearing 60 allowing its rotation about the axis of the right screw piston 52. The right driving bolt 58 also comprises an external thread 58*a* for its cooperation with a worm screw, as will be explained latter. The right driving bolt 58 is maintained in position by means of a second flange 62. A portion of the right screw piston 52 extends upwardly beyond the second flange 62 and is covered by a cap 64. The cap defines an oil inlet for lubrication of the assembly.

The right screw piston 52 is designed to push on the right sliding element 50 which in turn pushes on the housing of the roll shaft of the straightening machine provoking translation of the roll shaft, as this will be explained in more details under.

Referring now to FIGS. 3*a*, 3*b*,5 and 6*a* to 6*e* it will be seen that, the straightening machine further comprises at least four guides 66 ,66',68 and 68' for guiding the rotation of the roll shaft 14 about a virtual axis P transverse to the roll shaft axis X. The four guides 66, 66', 68 and 68 are fixedly connected to the frame 120 of the straightening machine and are horizontally spaced apart one from the other. Each guide 66, 66', 68 or 68' defines a convex surface which cooperates with a concave surface defined by a guided element 70, 70', 72, 72' of the roll shaft housing 12. In other words, elements 70, 70', 72, 72' are fixedly attached to the roll shaft housing 12 and move with this housing. In the embodiment shown on FIGS. 3*a*, 3*b*, 5 and 6*a* to 6*e*, elements 70, 70', 72 and 72' are sliding blocks of the roll shaft housing 12 extending from the roll shaft housing. Each sliding block 70, 70', 72 or 72' rotates with the housing guided by the corresponding guide 66, 66', 68 or 68. Each concave surface of each sliding block 70, 70', 72 or 72' is designed to slide on the convex surface of the corresponding guide 66, 66', 68 or 68 during the roll shaft anti-bending rotation, as can be seen on FIGS. 6*b* to 6*e*. The corresponding concave and convex surfaces of an assembly (A1, A1', A2 or A2', see FIG. 5) guide/guided element are complementary and define a contact surface S1, S2, S1' or S2' (visible on FIGS. 3*b* and 5). Furthermore, and as can be best seen on FIG. 5, two assemblies guide/guided element A1, A2 and two assemblies guide/guided element A1',A2' are respectively located on either side of a vertical plane passing through the roll shaft axis X.

Figure 3A:
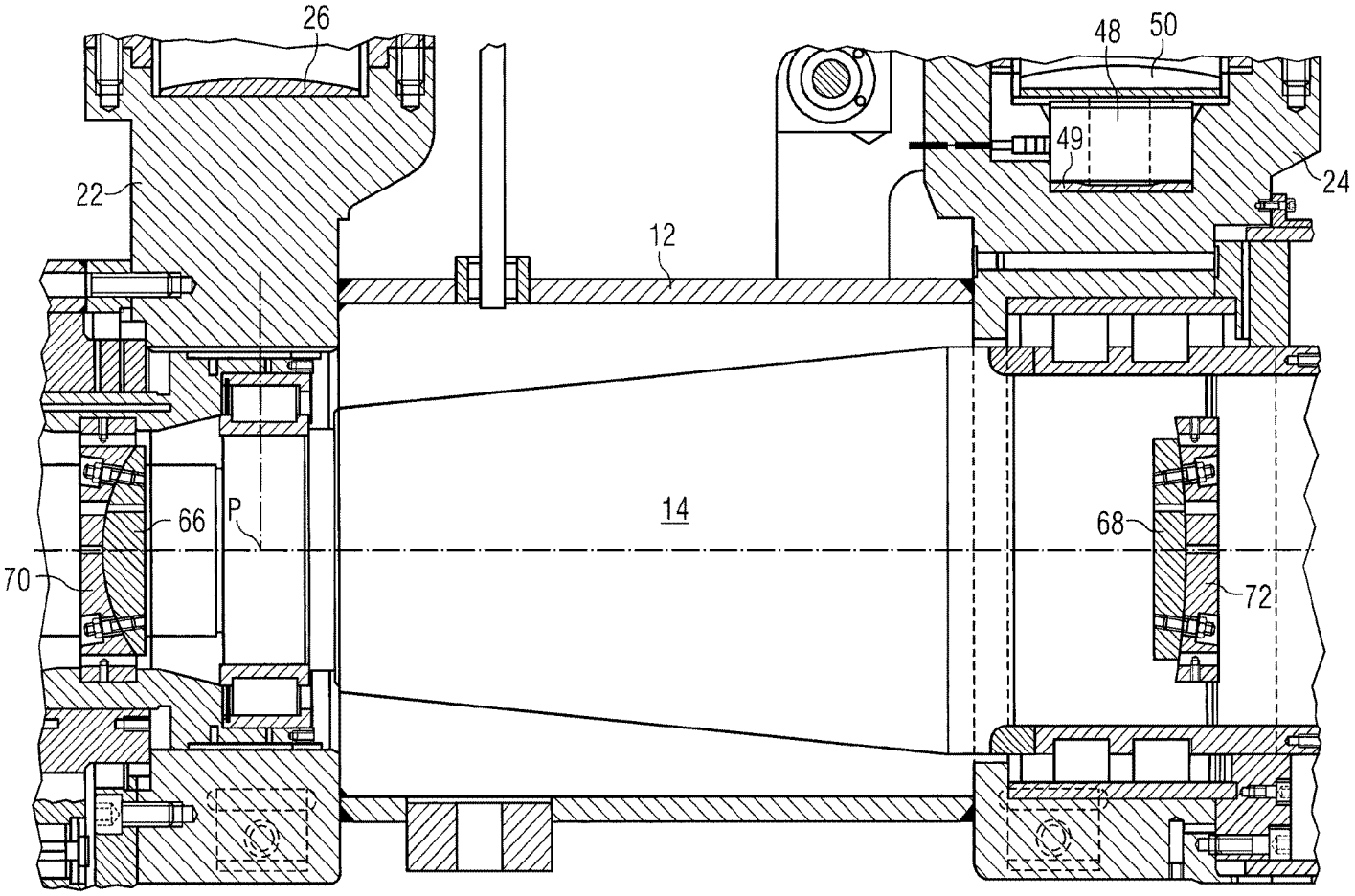
FIG. 3*a* is an enlargement of FIG. 1 showing the roll shaft and the rotations guides.
Figure 3B:
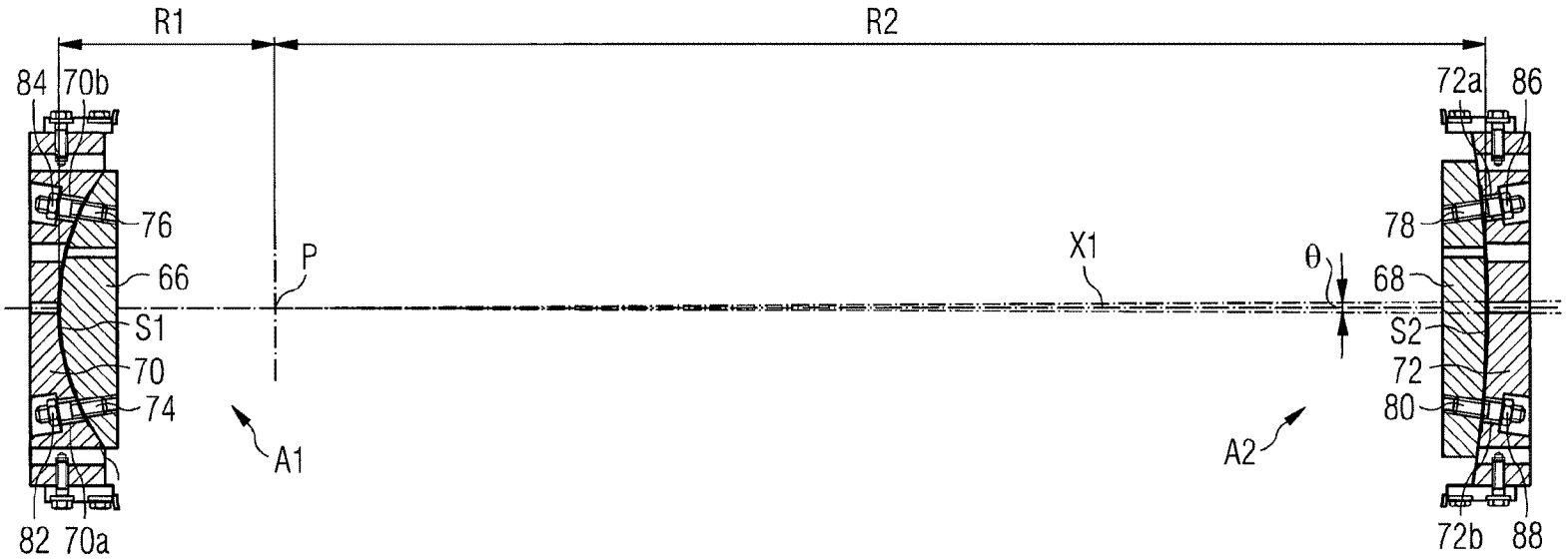
FIG. 3*b* is a detailed view of FIG. 1 showing only the rotation guides according to the invention.

In the longitudinal cross section shown in FIGS. 3*a* and 3*b* each contact surface S1 or S2 of each assembly is a line part of a virtual circle C1 or C2 (see FIG. 1). The first contact surfaces S1 and S2 and their locations are chosen such that the circles have different radii (R1 and R2), and such that the centres of the virtual circles C1 and C2 are superimposed. In other words the two virtual circles C1 and C2 have the same centre P. In this way, the virtual centre of rotation of the roll shaft is also the virtual centre of the circles C1 and C2.

Although only two assemblies guide/guided element are visible in FIGS. 3, it will be understood that in the very same manner each contact surface S1' or S2' of each assembly is a line part of a virtual circle C1' and C2'. The contact surfaces S1' and S2' and their locations are chosen such that the circles have different radii, and such that the centers of the virtual circles are superimposed. In other words, the two virtual circles S1' and S2' have the same centre P'. In this way, the virtual centre of rotation of the roll shaft is also the virtual centre of the circles C1' and C2'. The orthogonal projection of the above mentioned circles on the plane containing FIG. 1 gives circles C1' and C2' superimposed with the circles C1, and C2. This is why on FIG. 1, the same circles are labeled with two references C1, C1' and C2,C2'.

Further, the anti-bending rotation axis is transverse to the roll shaft axis X and passes trough points P and P'.

Each guide 66, 66', 70, 70' is fixed to the corresponding sliding block by way of spring screws 74, 76, or 78, 80. Each spring screw 74-80 is screwed in a thread of the guide 66 or 68 and passes through a cylindrical passage 70*a*, 70*b*, 72*a*, 72*b* defined by the shoulder 70 or 72, said passage having greater diameter than the diameter of the screw. Each spring 82,84,86,88 maintains its corresponding screw 74, 76, 78 or 80 in position in the passage 70*a*, 70*b*, 72*a*, 72*b*. The diameter difference between each passage 70*a*,70*b*,72*a*, 72*b* and the corresponding spring screw 74,76, 78 or 80 is a clearance which allows rotation of the sliding blocks 70, 70', 72 and 72', and therefore of the housing 12 of the roll shaft and of the roll shaft 14, with respect to the concave guides.

In FIG. 3*b*, only the guides and the sliding blocks of FIG. 3*a* are shown. The rotation angle θ represents the possible roll shaft anti-bending rotation amount. By way of example, in the embodiment shown on the figure, θ can vary between plus or minus 0°14' from a horizontal axis X1. In this embodiment, each guide 66, 68 (and also the guides 66' and 68' not shown on FIG. 3*b*) comprises a sliding convex surface and a flat opposed surface and each sliding block 70, 72 (and also 70', 72' not shown on FIG. 3*b*) has a general rectangular cross section with concave portion on one of the side of the rectangle. The concave and convex surfaces of an assembly guide/sliding block are complementary, this means that the surfaces fit together almost with no clearance.

Figure 4:
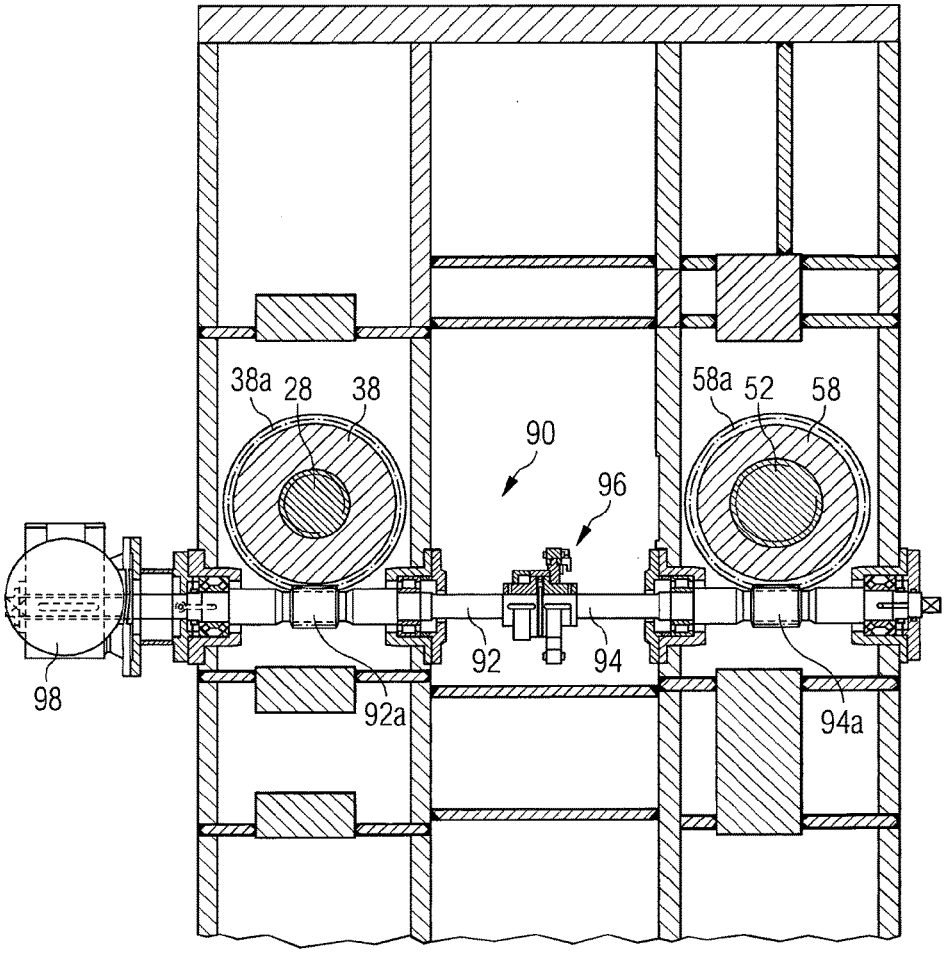
FIG. 4 is an horizontal cross section of FIG. 1 showing the driving system used for rotating the roll shaft according to the invention.
Figure 5:
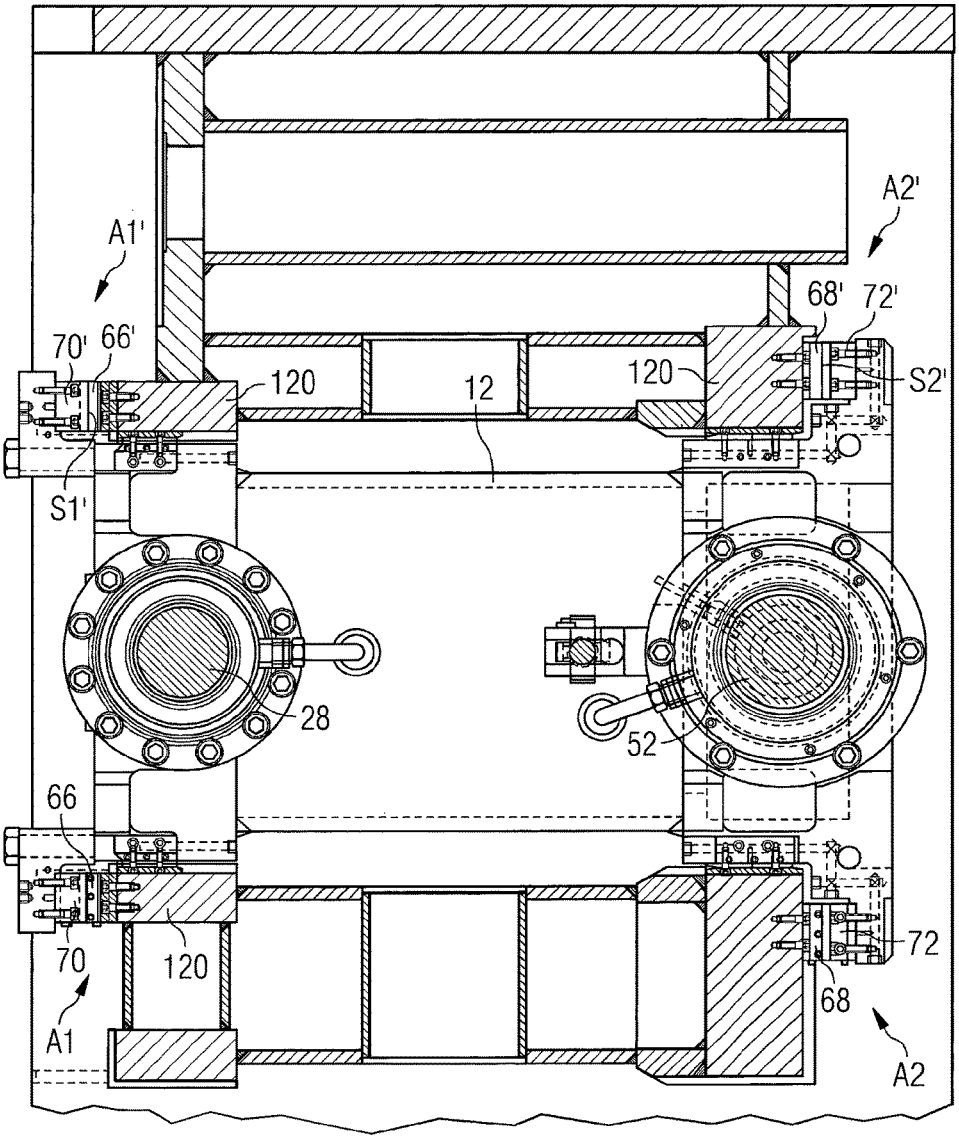
FIG. 5 is a top view of FIG. 1.

Referring now FIG. 4, the driving system of the driving bolts according to the invention will be described. Each driving bolt 38, 58, has an external screwed portion engaging with a worm screw system 90. The worn screw system 90 comprises two coaxial shafts 92, 94 (left and right when watching FIG. 4) which are able to be rotatably driven by a motor 98, each shaft 92, 94 having its worm screw 92*a*, 94*a* in engagement with a corresponding driving bolt 38*a* or 58*a*. Interposed between the two shafts 92 and 94 is a gear coupling system 96 whose displacement allows selective transmission of the rotation motion induced by the motor 98 to the right driving shaft 94. Each driving shaft 92,94 has a geared end and the gear coupling system 96 is able to translate along the axis of the shafts 92 and 94 to connect left and right shafts 92 and 94 for their rotation via their geared end.

As an example, the gear coupling system 96 can be a Gear coupling with a Coupling-clutch Combination. As can be best seen in FIG. 2, the gear coupling system is driven in translation by means of a shift fork 100 (shown in two different positions in FIG. 2) in turn driven by a cylinder 102. Thanks to this driving system each worn screw 38, 58 can be driven independently and the anti-bending rotation of the roll shaft can be precisely controlled.

When an anti-bending correction is needed, the gear coupling system is shifted such that only the left shaft 92 is driven. This is done by displacing the cylinder 102 driving the shift fork 100 (see FIG. 2). Thereafter the anti-bending motor 98 is rotated and drives the left worn screw 38 which in turns drives the left bolt 28. Rotation of the left bolt 38 provokes the translation of the left screw piston 28 upward or downward depending on the direction of rotation of the anti-bending motor 98. While translating, the left screw piston 28 pushes or pulls the left arm which in turn pushes or pulls the roll shaft housing 12, and therefore the roll shaft 14 and the straightening roll 20. The fact that only the left screw piston 28 translates for the anti-bending correction, the right screw piston 52 being fixed, combined with the shape and location of:

the guides/guided element assemblies 66/70 (A1),66'/70' (A1'), 68/72 (A2), 62'/72' (A2'), the concave contact surfaces of both screw pistons 28 and 52, the sliding surfaces 26, 50 provokes a controlled rotation of roll shaft 14 around an axis transverse to the roll shaft axis and passing through the virtual center P of circles C1 and C2 and C3 (see FIG. 1). Indeed, the rotation of the roll shaft housing is guided by the first guides 66, 66' and the first shoulders 70, 70' forming first pivoting links and by the second guides 68, 68' and second shoulders 72, 72' forming second pivoting links, the resulting movement being a rotation about the above mentioned transverse axis passing by points P and P' and driven by the translation of the left screw piston 28. During anti-bending rotation of the roll shaft 14 about axis PP', each sliding element 70,70',72,72' slides on its corresponding guide 66, 66',68,68'.

Figure 6D:
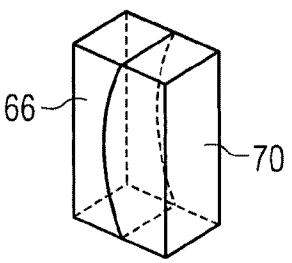
FIGS. 6*a* to 6*e* are schematic views of a straightening machine according to the invention.
Figure 6B:
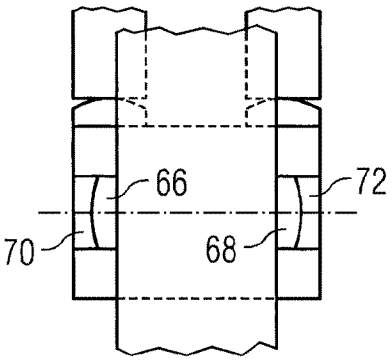
Figure 6E:
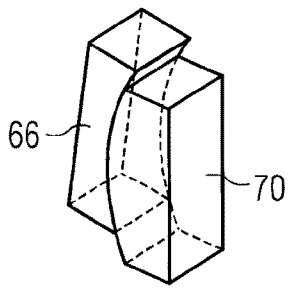
Figure 6C:
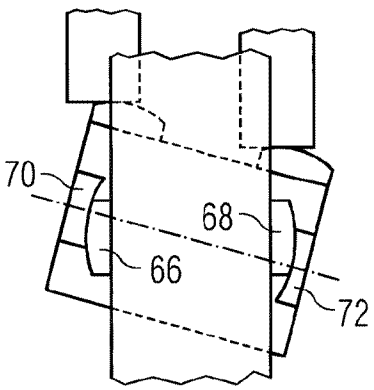
Figure 6A:
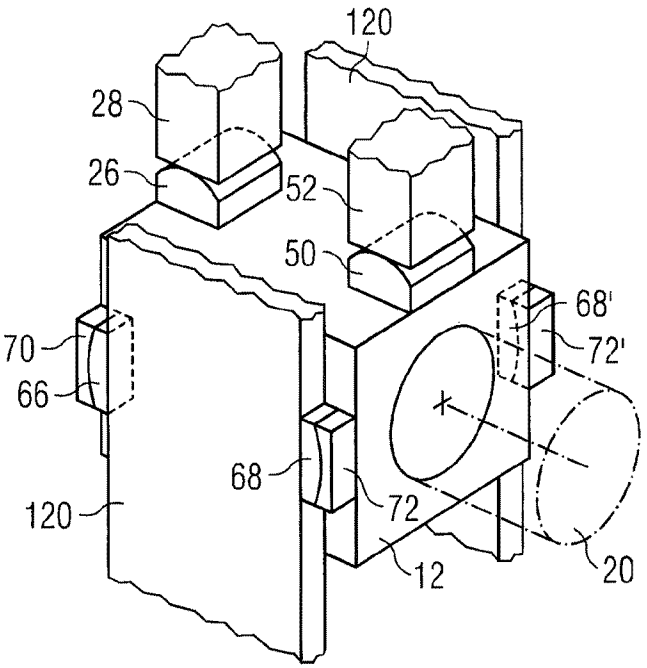

The motion of sliding blocks 70,72 relative to the guides 66, 68 is shown in schematic manner in FIGS. 6*b* to 6*e*. FIG. 6*b* is a front view of FIG. 6*a* before the anti-bending rotation and FIG. 6*d* is a schematic tridimensional view of the an assembly guide/sliding block before an anti bending rotation. FIG. 6*c* is a front view of FIG. 6*a* after the anti-bending rotation and FIG. 6*e* is a schematic tridimensional view of the assembly guide/sliding block after an anti bending rotation. As it can be seen on FIGS. 6*c* and 6*e*, during the anti-bending rotation sliding blocks 70 and 72 rotate relative to the corresponding guides 66, 68'.

Furthermore, during rotation of the roll shaft 14, each sliding element 26, 50 located in each recess of each arm rotates also and slides on the corresponding concave surface of the corresponding end 28a, 52*a* of each screw piston 28 and 52.

When the vertical distance between two consecutive rolls of the straightening machine 10 according to the invention needs to be modified, the gear coupling system 96 is shifted such that both shafts 92 and 94 are driven. When this happens, the roll shaft housing 12 is completely translated vertically upward or downward depending on the rotation direction of the driving motor 98. Subsequently, both screw pistons 28 and 52 are translated, by rotation of their respective bolt 38 and 58, and push or pull the roll shaft housing.

Therefore, the invention can be used in two different modes, anti-bending correction mode and vertical rolls distance setting mode.

As above mentioned a load sensor 48 is provided giving the load applied on the right arm of the roll shat housing. This sensor is also used to sense the value of the bending induced by the straightening of the product. In this manner, a corrective anti-bending control loop can be established with a given set value depending on the bending value. This setting value is sent to the motor to control the number of rotation of the driving shaft 92. In this way the bending induced by the straightening of the product can be accurately corrected.

With the invention, and as above shown, the loads are distributed on the extended contact surfaces and wearing of mechanical parts of the straightening machine is reduced in comparison with solutions of the prior art which lead to higher clearance and reduced contact lines. On the contrary, the invention achieves extended contact surfaces, reduced clearance and reduced parts wearing.

The invention claimed is:

1. A straightening machine, comprising:

a frame;

roll shaft housings supported by said frame, each of said roll shaft housings) receiving a roll shaft having an axis and being rotatable about the axis;

at least one first assembly including a first guide defining a first convex surface and a first corresponding guided element defining a first concave surface, said first surfaces contacting each other at a first contact surface;

at least one second assembly including a second guide defining a second convex surface and a second corresponding guided element defining a second concave surface, said second surfaces contacting each other at a second contact surface; and a device for rotating at least one of said roll shaft housings with a rotation being guided by said assemblies about a virtual axis transverse to the roll shaft axis to compensate bending due to straightening of a product.

2. The straightening machine according to claim 1, which further comprises:

at least one third assembly including a third guide defining a third convex surface and a third corresponding guided element defining a third concave surface, said third surfaces contacting each other at a third contact surface; and at least one fourth assembly including a fourth guide defining a fourth convex surface and a fourth corresponding guided element defining a fourth concave surface, said fourth surfaces contacting each other at a fourth contact surface;

said third and fourth assemblies also guiding the rotation of at least one of said roll shaft housings about the virtual axis transverse to the roll shaft axis to compensate bending due to straightening of a product.

3. The straightening machine according to claim 1, which further comprises:

first and second virtual circles having different radii and the same virtual center;

said first and second assemblies each having a contact line and being constructed and located to place said contact lines of each of said first and second assemblies at a part of a respective one of said first and second virtual circles, in a longitudinal cross section of the roll shaft; and said roll shaft housing being rotatable about said virtual center for correction of the bending induced by the product to be straightened.

4. The straightening machine according to claim 3, wherein said device for rotating said roll shaft housing includes a first convex surface and a first concave surface defining a first contact surface therebetween, and in a longitudinal cross section of said roll shaft housing, said first contact surface is a contact line (S3) being part of another virtual circle also having the same virtual center.

5. The straightening machine according to claim 4, wherein said device for rotating said roll shaft housing includes a second convex surface and a second concave surface defining a second contact surface therebetween.

6. The straightening machine according to claim 1, wherein said guides are fixedly attached to said frame.

7. The straightening machine according to claim 1, wherein said guided elements are fixedly attached to one of said roll shaft housings and rotate with said one roll shaft housing during anti-bending rotation.

8. The straightening machine according to claim 1, which further comprises spring screws attaching each of said guides to a respective corresponding one of said guided elements, said spring screws being received in respective recesses in each of said guides and in each of said guided elements, and said spring screws allowing rotation of said guided elements relative to said guides during anti-bending rotation of said roll shaft housing.

9. The straightening machine according to claim 8, wherein said spring screws have diameters, each recess of each guided element receiving a spring screw has a diameter greater than said diameter of said spring screw defining a clearance between said spring screw and a wall of said recess of said guided element, said spring screw is fixedly screwed in said recess of said corresponding guide, and said clearance allows rotation of each guided element relative to said guide during anti-bending rotation of said roll shaft housing.

10. The straightening machine according to claim 1, wherein said device for rotating said roll shaft housing includes:

a first screw piston with an extremity defining a concave surface, a first sliding element including a convex surface complementary to and cooperating with said concave surface of said first screw piston, a second screw piston with an extremity defining a concave surface, and a second sliding element including a convex surface complementary to and cooperating with said concave surface of said second screw piston, each of said screw pistons being received and maintained in a passage formed in said frame.

11. The straightening machine according to claim 10, wherein said device for rotating said roll shaft housing includes at least two driving bolts, each of said driving bolts cooperating with a respective one of said screw pistons for translating each of said screw pistons, and each of said driving bolts having an external threaded portion.

12. The straightening machine according to claim 11, wherein said device for rotating said roll shaft housing includes at least two aligned driving shafts, each of said driving shafts engaging with said external threaded screwed portion of a respective one of said driving bolts for rotating each of said screw pistons.

13. The straightening machine according to claim 12, wherein:

said device for rotating said roll shaft housing includes a driving motor;

each of said driving shafts has a threaded extremity;

a gear coupling system is interposed between said two driving shafts, and said gear coupling system is displaceable between:

a first position in which only one of said driving shafts is rotated by said driving motor, leading to the rotation of said roll shaft housing and, a second position in which both of said driving shafts are rotated by said driving motor causing translation of said roll shaft housing.

14. The straightening machine according to claim 13, wherein said device for rotating said roll shaft housing includes a cylinder and a shift fork driven by said cylinder, said shift fork displacing said gear coupling system back and forth between said first and second positions.

15. The straightening machine according to claim 10, which further comprises at least two arms, each of said arms defining a respective recess, and each of said recesses receiving an end of a respective one of said screw pistons and a respective one of said sliding elements.

* * * * *